US008585359B2

(12) United States Patent
Yu et al.

(10) Patent No.: US 8,585,359 B2
(45) Date of Patent: Nov. 19, 2013

(54) HEAT DISSIPATION DEVICE AND CENTRIFUGAL FAN THEREOF

(75) Inventors: Fang-Xiang Yu, Shenzhen (CN); Xian-Min Jin, Shenzhen (CN); Jer-Haur Kuo, Taipei Hsien (TW)

(73) Assignees: Fu Zhun Precision Industry (Shen Zhen) Co., Ltd., Shenzhen (CN); Foxconn Technology Co., Ltd., New Taipei (TW)

( * ) Notice: Subject to any disclaimer, the term of this patent is extended or adjusted under 35 U.S.C. 154(b) by 840 days.

(21) Appl. No.: 12/770,783

(22) Filed: Apr. 30, 2010

(65) Prior Publication Data

US 2011/0247789 A1 Oct. 13, 2011

(30) Foreign Application Priority Data

Apr. 7, 2010 (CN) ..... 2010 1 0140938

(51) Int. Cl.
*F04D 29/44* (2006.01)

(52) U.S. Cl.
USPC ..... 415/177; 415/211.2

(58) Field of Classification Search
USPC ..... 415/177, 182.1, 208.1, 208.2, 208.3, 415/208.4, 211.1, 211.2, 224, 206; 361/695, 696
See application file for complete search history.

(56) References Cited

U.S. PATENT DOCUMENTS

| | | | | |
|---|---|---|---|---|
| 2006/0081367 | A1* | 4/2006 | Chiu et al. | 165/296 |
| 2008/0011461 | A1* | 1/2008 | Hwang et al. | 165/122 |
| 2008/0093056 | A1* | 4/2008 | Hwang et al. | 165/104.33 |

* cited by examiner

*Primary Examiner* — Edward Look
*Assistant Examiner* — Maxime Adjagbe
(74) *Attorney, Agent, or Firm* — Altis & Wispro Law Group, Inc.

(57) ABSTRACT

A centrifugal fan includes a casing and an impeller received in the casing. The casing defines an air outlet at one side thereof. An air channel is defined in the casing between a sidewall of the casing and outermost free ends of blades of the impeller. The air channel has an upstream end and a downstream end along a rotation direction of the impeller. A plurality of air guide plates is formed in the casing and disposed at a junction between the downstream end of the air channel and an area of the air outlet directly communicating with the downstream end of the air channel. The air guide plates are structured and arranged in a streamlined manner and pattern with respect to air flowing from the downstream end of the air channel towards the air outlet.

2 Claims, 4 Drawing Sheets

HEAT DISSIPATION DEVICE AND CENTRIFUGAL FAN THEREOF

BACKGROUND

1. Technical Field

The present disclosure relates to heat dissipation devices, and particularly to a heat dissipation device incorporating a centrifugal fan.

2. Description of Related Art

Heat dissipation devices are often applied to dissipate heat from heat generating components, such as central procession units (CPUs). FIG. 1 shows a conventional heat dissipation device 200. The heat dissipation device 200 includes a fin assembly 90 thermally connected with a heat generating component (not shown), and a blower 80. The blower 80 includes a housing 82, and an impeller 84 received in the housing 82. The blower 80 defines an air outlet 822 at one side thereof. The fin assembly 90 is located at the air outlet 822 of the blower 80.

During operation of the heat dissipation device 200, the fin assembly 90 absorbs heat from the heat generating component and dissipates the heat to the ambient environment. The impeller 84 of the blower 80 rotates clockwise and drives air to the fin assembly 90 to evacuate heat from the fin assembly 90. However, as shown in FIG. 1, a large quantity of air flows to a right-hand side of the air outlet 822, whereas less air flows to an opposite left-hand side of the air outlet 822, and even less air flows to a center of the air outlet 822. Thus, the blower 80 does not fully optimize cooling of a portion of the fin assembly 90 located at the center of the air outlet 822. In addition, uneven distribution of the airflow at the air outlet 822 can generate a plurality of vortexes at the center of the air outlet 822.

Thus, it is desired to overcome the described limitations.

DETAILED DESCRIPTION

Figure 1:
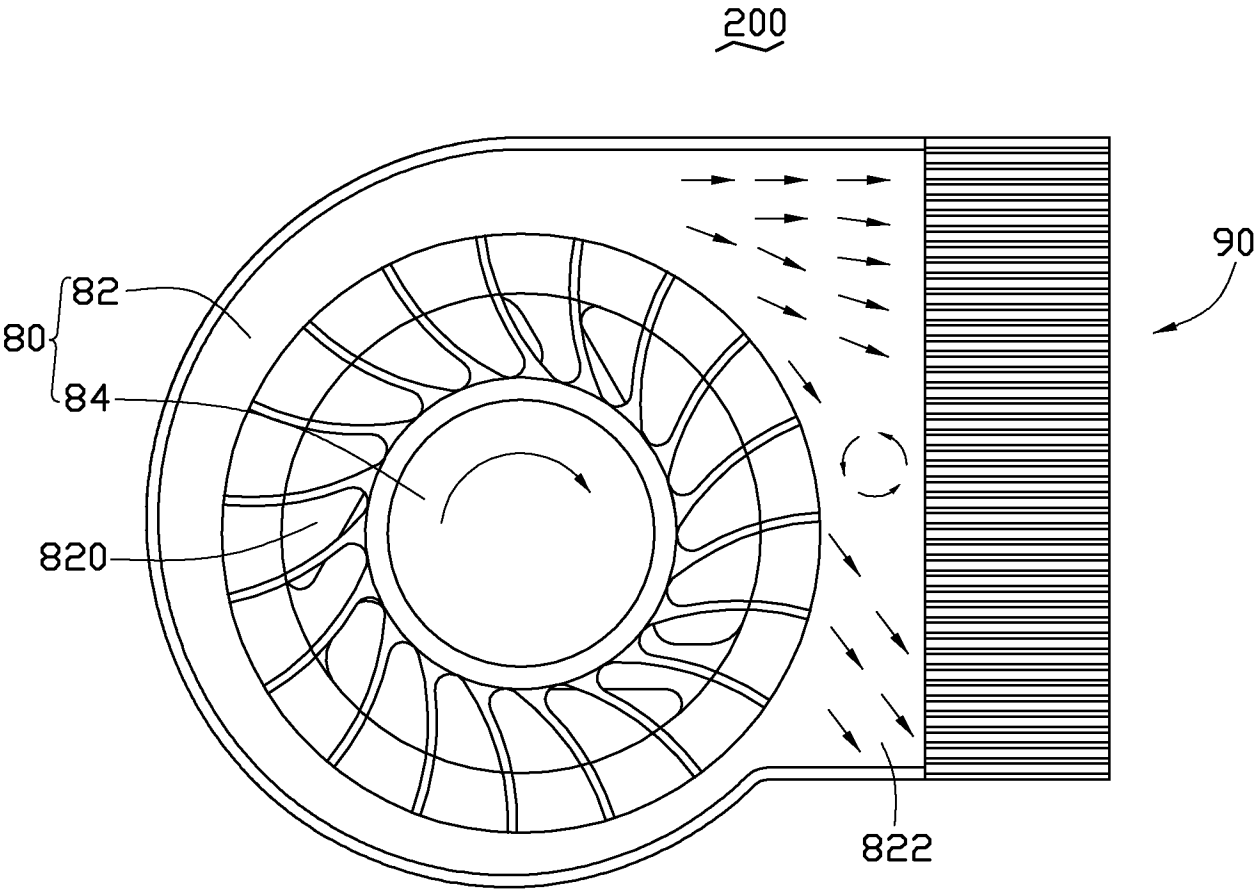
FIG. 1 (RELATED ART)
FIG. 1 is a top plan view of a blower of a frequently used heat dissipation device, but not showing a cover thereof, and showing airflow paths inside the blower.
Figure 2:
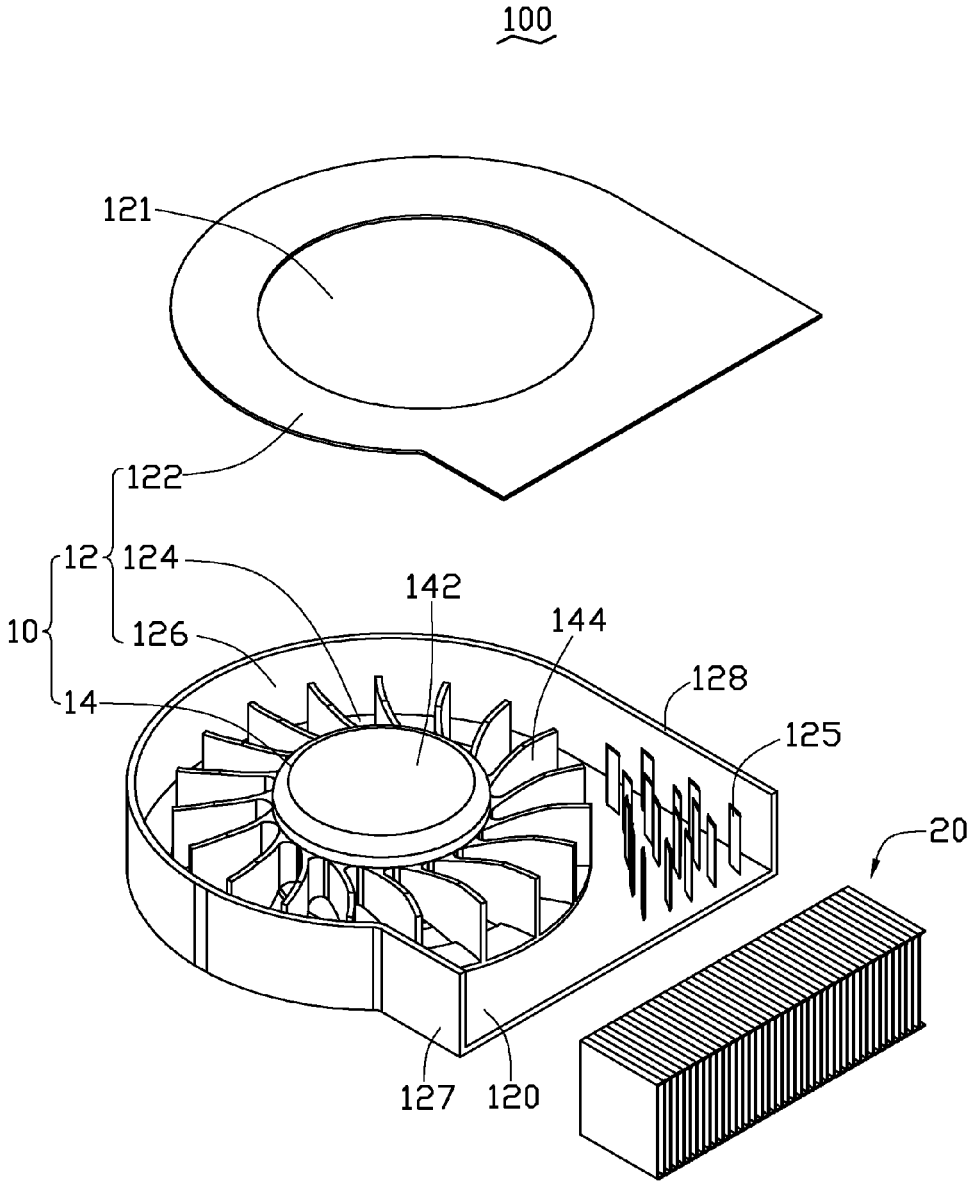
FIG. 2 is an exploded, isometric view of a heat dissipation device in accordance with an exemplary embodiment, the heat dissipation device including a cover.
Figure 3:
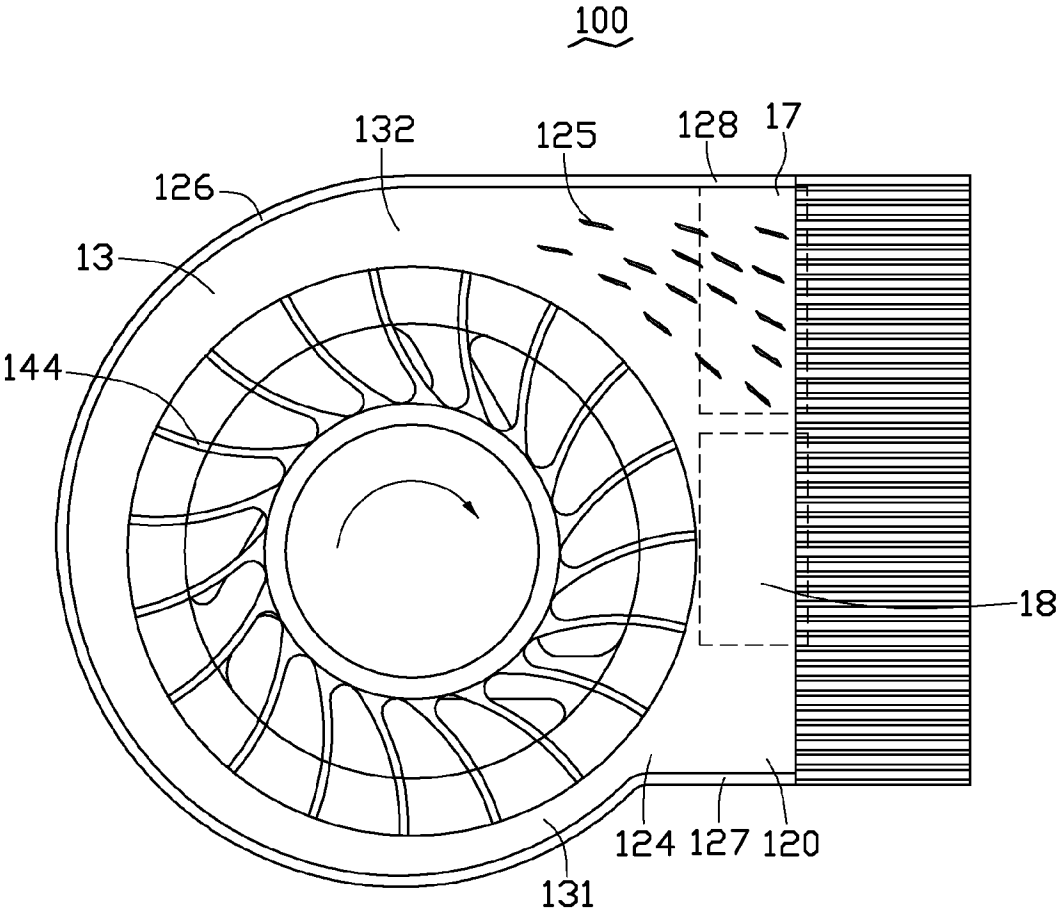
FIG. 3 is an assembled top plan view of the heat dissipation device of FIG. 2, with the cover removed.

FIGS. 2 and 3 show a heat dissipation device 100 in accordance with an exemplary embodiment. The heat dissipation device 100 includes a centrifugal fan 10, and a fin assembly 20 adjacent to the centrifugal fan 10. The fin assembly 20 includes a plurality of fins (not labeled) stacked together. The centrifugal fan 10 includes a casing 12, and an impeller 14 received in the casing 12. The impeller 14 includes a hub 142, and a plurality of blades 144 extending radially and outwardly from an outer periphery of the hub 142. The casing 12 includes a top cover 122, a bottom plate 124, and a sidewall 126 connecting the top cover 122 with the bottom plate 124. The top cover 122, the bottom plate 124 and the sidewall 126 cooperatively define a receiving space (not labeled) therein for receiving the impeller 14.

The top cover 122 defines an air inlet 121 at a center thereof. The impeller 14 is mounted to the bottom plate 124 and aligned with the air inlet 121 of the top cover 122. The sidewall 126 extends perpendicular to a circumference of the bottom plate 124, and an air outlet 120 is defined between two ends of the sidewall 126. The impeller 14 is spaced from the sidewall 126, with an air channel 13 defined between the sidewall 126 and outermost free ends of the blades 144 of the impeller 14. A width of the air channel 13 gradually increases along a rotation direction of the impeller 14, such that the air channel 13 defines a narrow portion 131 at an upstream end of the air channel 13 and a wide portion 132 at a downstream end of the air channel 13.

The sidewall 126 includes a first plate 127, and a second plate 128 facing and parallel to the first plate 127. The first plate 127 and the second plate 128 are spaced from each other and located at opposite sides of the air outlet 120, with the air outlet 120 defined therebetween. The first plate 127 is located adjacent to the narrow portion 131 of the air channel 13, while the second plate 128 is located adjacent to the wide portion 132 of the air channel 13. The air outlet 120 defines a first area 17 near the second plate 128 of the sidewall 126, and a second area 18 at a central portion of the air outlet 120. The first area 17 is located at a right-hand side of the air outlet 120, and communicates with the wide portion 132 of the air channel 13. The first area 17 is located between the second area 18 and the second plate 128 of the sidewall 126.

The bottom plate 124 of the casing 12 forms a plurality of slim air guide plates 125 at the wide portion 132 of the air channel 13 near the air outlet 120 and at the first area 17 of the air outlet 120. The air guide plates 125 are integrally formed with and extend upwardly from the bottom plate 124. That is, the air guide plates 125 and the bottom plate 124 are portions of a single, one-piece, monolithic body of the one same material. Alternatively, the air guide plates 125 can be fixed on the bottom plate 124 after the bottom plate 124 and the air guide plates 125 have been separately formed.

Each air guide plate 125 is rectangular and includes an inner end and an opposite outer end. The outer end is located closer to the air outlet 120 than the inner end. The outer end is farther from the second plate 128 than the inner end. Thus, the air guide plates 125 are obliquely angled with respect to the second plate 128 of the sidewall 126. An angle with respect to the second plate 128 of the air guide plates 125 nearer the second plate 128 is less than that of the air guide plates 125 distant from the second plate 128.

The air guide plates 125 are arranged in a generally streamlined pattern from the wide portion 132 of the air channel 13 towards the first area 17 of the air outlet 120. The air guide plates 125 are arranged with air passages defined between each two neighboring lines of one or more air guide plates 125. The number of air guide plates 125 increases from the wide portion 132 of the air channel 13 to the air outlet 120, and an area occupied by the air guide plates 125 gradually increases from the wide portion 132 of the air channel 13 to the air outlet 120. Thus a portion of the air guide plates 125 nearest to the second area 18 of the air outlet 120 is those air guide plates 125 in a portion of the first area 17 of the air outlet 120 that is nearest to the second area 18. Put another way, said portion of the air guide plates 125 can be considered to be arranged to generally extend towards the second area 18 of the air outlet 120.

Figure 4:
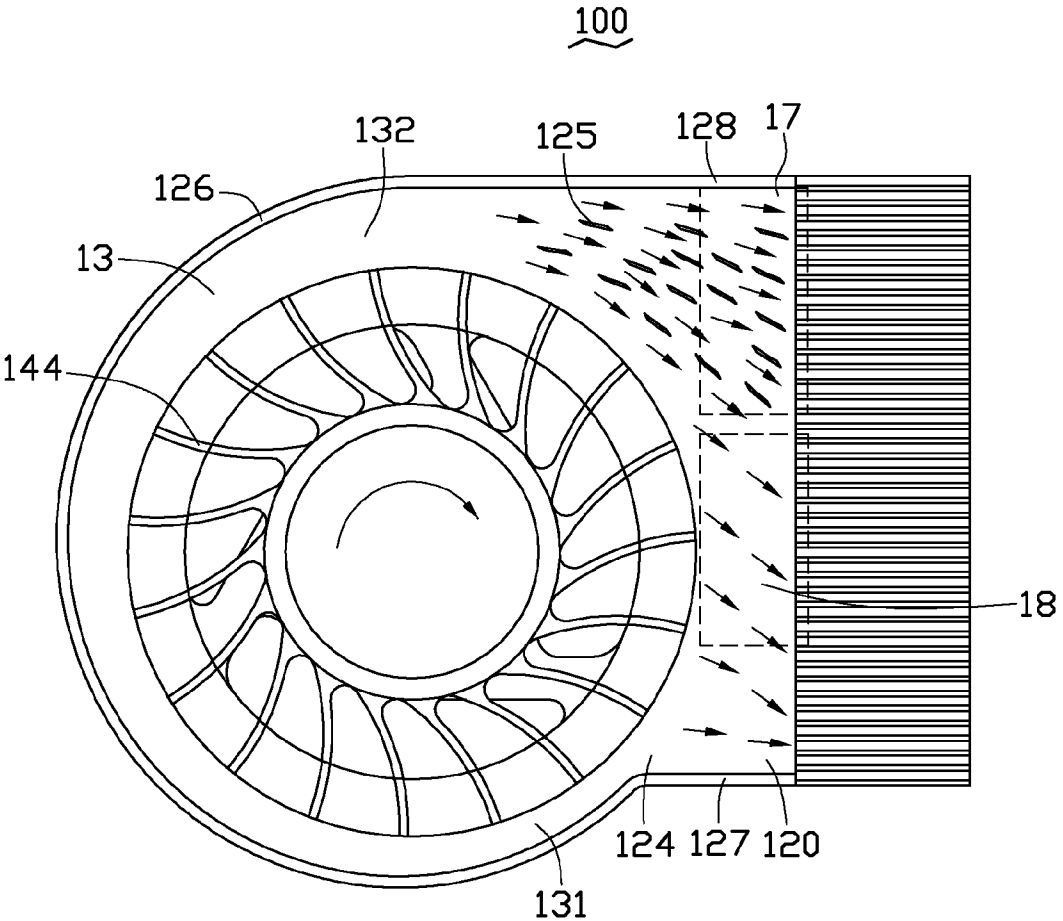
FIG. 4 is similar to FIG. 3, but showing airflow paths inside the heat dissipation device.

Referring also to FIG. 4, during operation of the centrifugal fan 10, the impeller 14 rotates and drives air from the air inlet 121 into the air channel 13 of the casing 12. The air flows from the narrow portion 131 to the wide portion 132 of the air channel 13, and then to the air outlet 120. Since the air initially flows from the air channel 13 to the first area 17 of the air outlet 120, the airflow at the first area 17 is highest. In contrast, the airflow to and at the second area 18 is less, because the air pressure decreases sharply after the air leaves the air channel 13.

Due to the presence of the air guide plates 125, a portion of the airflow heading to the first area 17 is guided by the air guide plates 125 towards the second area 18, where airflow is increased accordingly. As a result, the heat dissipation efficiency of the fins of the fin assembly 20 located at the second area 18 is improved. In addition, the air guide plates 125 are structured and arranged in a streamlined manner and pattern, which can minimize or avoid airflow resistance through the air guide plates 125.

It is to be understood, however, that even though numerous characteristics and advantages of the exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A heat dissipation device, comprising:

a centrifugal fan comprising a casing and an impeller received in the casing, the casing comprising a top cover, a bottom plate, and a sidewall connecting the top cover with the bottom plate, and the casing defining an air outlet at one side thereof between the top cover and the bottom plate; and a fin assembly located adjacent to the air outlet of the centrifugal fan, a bottom end of the fin assembly being coplanar with a bottom surface of the bottom plate;

wherein an air channel is defined in the casing between a sidewall of the casing and outermost free ends of blades of the impeller, the air channel comprising an upstream end and a downstream end along a rotation direction of the impeller, a plurality of air guide plates formed in the casing and disposed at a junction between the downstream end of the air channel and an area of the air outlet directly communicating with the downstream end of the air channel, the air guide plates structured and arranged in a streamlined manner and pattern with respect to air flowing from the downstream end of the air channel towards the air outlet and guiding one or more portions of such flowing air generally toward another area of the air outlet not directly communicating with the downstream end of the air channel;

wherein the air channel defines a narrow portion at the upstream end of the air channel and a wide portion at the downstream end of the air channel, the air outlet defines a first area near the wide portion of the air channel and a second area at a central portion of the air outlet, and the air guide plates are located at the wide portion of the air channel near the air outlet and at the first area of the air outlet, the number of air guide plates increases from the wide portion of the air channel to the air outlet, and an area occupied by the air guide plates gradually increases from the wide portion of the air channel to the air outlet.

2. The heat dissipation device of claim 1, wherein each of a plurality of the air guide plates more distant from the second plate guides one or more portions of said one or more portions of such flowing air generally towards the second area of the air outlet.

* * * * *